US007174686B1

(12) United States Patent
Legband

(10) Patent No.: US 7,174,686 B1
(45) Date of Patent: Feb. 13, 2007

(54) BRACKET FOR USE IN REPANELING A STRUCTURE

(75) Inventor: Arnold G. Legband, Fremont, NE (US)

(73) Assignee: Evelyn Legband, Fremont, NE (US)

( * ) Notice: Subject to any disclaimer, the term of this patent is extended or adjusted under 35 U.S.C. 154(b) by 324 days.

(21) Appl. No.: 10/667,000

(22) Filed: Sep. 18, 2003

(51) Int. Cl.
*E04D 1/36* (2006.01)

(52) U.S. Cl. ..... 52/471; 52/462; 52/464; 52/478; 52/506.05; 52/544; 52/549; 52/550; 52/713

(58) Field of Classification Search ..... 52/394, 52/395, 461–470, 404, 519, 520, 542, 544, 52/545, 550, 469, 578, 549, 506.05, 713
See application file for complete search history.

(56) References Cited

U.S. PATENT DOCUMENTS

| | | | | | |
|---|---|---|---|---|---|
| 2,192,719 | A | * | 3/1940 | Tapman | 52/464 |
| 2,855,871 | A | * | 10/1958 | Huntington | 52/461 |
| 2,907,287 | A | * | 10/1959 | Trostle | 52/463 |
| 3,253,375 | A | * | 5/1966 | Takehara | 52/478 |
| 4,285,182 | A | * | 8/1981 | Dinges | 52/478 |
| 4,366,656 | A | * | 1/1983 | Simpson | 52/395 |
| 4,400,922 | A | * | 8/1983 | Boyer | 52/394 |
| 4,400,924 | A | * | 8/1983 | Andrews | 52/466 |
| 4,406,106 | A | * | 9/1983 | Dinges | 52/478 |
| 4,476,658 | A | * | 10/1984 | Johnstone | 52/395 |
| 4,486,998 | A | * | 12/1984 | Hague | 52/478 |
| 4,494,343 | A | | 1/1985 | Berry et al. | |
| 4,546,586 | A | * | 10/1985 | Knudson | 52/469 |
| 4,590,730 | A | * | 5/1986 | Blendick | 52/461 |
| 4,671,038 | A | * | 6/1987 | Porter | 52/586.1 |
| 4,909,013 | A | * | 3/1990 | Daw et al. | 52/762 |
| 4,914,886 | A | * | 4/1990 | Eriksson et al. | 52/537 |
| 5,152,115 | A | * | 10/1992 | Cotter | 52/466 |
| 5,187,911 | A | * | 2/1993 | Cotter | 52/469 |
| 5,367,848 | A | | 11/1994 | McConnohie | |
| 5,423,157 | A | * | 6/1995 | Watanabe | 52/745.08 |
| 5,511,354 | A | * | 4/1996 | Eidson | 52/544 |
| 5,600,971 | A | * | 2/1997 | Suk | 52/713 |
| 5,636,488 | A | * | 6/1997 | Lawrence et al. | 52/521 |
| 5,715,639 | A | * | 2/1998 | Yamada | 52/528 |
| 5,737,892 | A | * | 4/1998 | Greenberg | 52/469 |
| 5,845,446 | A | * | 12/1998 | Funaki et al. | 52/461 |

* cited by examiner

*Primary Examiner*—Naoko Slack
*Assistant Examiner*—Yvonne M. Horton
(74) *Attorney, Agent, or Firm*—Thomte, Mazour & Niebergall; Shane M. Niebergall

(57) ABSTRACT

A bracket for use in retrofitting building panels to a structure is provided with forward, rearward and top walls which define a channel therebetween. The channel is sized and shaped to substantially enclose existing fasteners on the structure to substantially prevent lateral movement of the bracket along the existing building panels. The lower end portion of the bracket is shaped to marry the profile of the existing building panels. A single series of fasteners secure the new building panel to the bracket, the existing building panel and preferably the frame of the structure.

15 Claims, 3 Drawing Sheets

BRACKET FOR USE IN REPANELING A STRUCTURE

BACKGROUND OF THE INVENTION

The present invention relates to building materials and more particularly to an elongated bracket that is used in retrofitting new building panels to existing structures with minimal labor and additional materials.

DESCRIPTION OF THE PRIOR ART

Lightweight steel-framed structures typically employ ribbed building panels to cover the roof and walls of the structure. Oftentimes, the building panels are constructed from metal, such as steel or aluminum. The building panels are formed to have a rib and valley profile to strengthen the building panels despite their thin construction.

Over time, due to natural deterioration or damage from various causes, the building panels on structures need to be replaced. However, the removal and replacement of the building panels consumes a great deal of labor and financial resources. Oftentimes, the best solution to the repair of a structure having deteriorating or damaged building panels is to simply retrofit the structure with new roof or wall panels by directly securing the new building panels to the existing building panels. In this manner, the labor and expense of removing the existing building panels can be saved.

A number of concerns arise when retrofitting a structure with new building panels. First, the spacing between the new and existing building panels must be taken into consideration. Second, the ability for wind to flow beneath the new building panels, causing a sail-like effect, must be considered for its potential for property damage and injury. Finally, the manner in which the new building panels are coupled to the structure must be carefully considered. As the new and existing body panels are subjected to a range of temperatures, their rates of expansion and contraction may differ to a varying degree. Moreover, the more complex retrofitting the structure becomes, the cost/benefit ratio of the retrofitting the structure as compared to replacing the building panels decreases.

One example of a system for retrofitting a structure with new building panels is taught by U.S. Pat. No. 5,367,848. The system is essentially provided with an elongated bracket having a Z-shaped cross-section. The bracket is designed to extend transversely across the existing building panels adjacent the location of a frame member. A series of notches are formed within the one generally vertical wall member of the Z-shaped bracket to allow the bracket to "nest" onto and over the ribbed profile of the existing building panel. A bottom wall portion extends outwardly from the bracket and is provided with apertures so that the user may secure the bracket to the existing building panel and the frame member using a plurality of new fasteners. A top wall member provides a mating surface for supporting the new building panel. A second series of new fasteners are used to secure the new building panel to the bracket. While the design of the bracket solved a number of problems existing in the art at the time it was introduced, it still suffers from a number of deficiencies. First, the goal in retrofitting building panels is to reduce the overall labor and materials required to retrofit the new building panels onto the structure. The design of the Z-shaped bracket requires a first course of fasteners to secure the bracket to the existing building panel and frame member. Then, a second course of fasteners is required to secure the new building panel to the bracket. An additional deficiency with the bracket stems from its Z-shaped design. The bottom wall member is secured to the existing building panel and the frame member, and the new building panel is fastened only to the top wall member of the bracket. Accordingly, there is no direct structural connection between the new building panel and the frame member of the building. The strength of the connection between the new building panel and the building itself depends upon the strength of the bracket. Moreover, the Z shape provides only one vertically-oriented wall member, which provides a less than desirable level of stability when forces are exerted on the new building panels.

Accordingly, what is needed is a new system and method for retrofitting building panels to a structure that not only provides a convenient manner of retrofitting building panels but also decreases the labor and materials required to implement the system while increasing the overall stability of the new building panels with respect to the structure.

SUMMARY OF THE INVENTION

The novel bracket of the present invention is provided for use in retrofitting new building panels to a structure having existing building panels that are fastened to frame members. The bracket is generally provided with a forward wall and a rearward wall that are coupled to one another at their upper end portions by a top wall. The interconnection between the forward, rearward and top walls defines a channel that extends along the length of the bracket. Accordingly, in one preferred embodiment, the bracket is generally U-shaped.

The bottom end portions of the forward and rearward walls are selectively shaped to mimic the rib and valley profile of the existing building panels, permitting the bracket to substantially engage its lower end portion with the upper surface of the existing building panel. The channel is shaped and sized to substantially enclose the existing fasteners, which couple the existing building panel to the frame member. Accordingly, a single elongated bracket may be positioned to enclose a transverse line of fasteners across the existing building panel, preventing the bracket from sliding forward or rearward with respect to the existing building panel. A single course of fasteners are then used to secure the new building panel to the bracket and the existing building panel. In a preferred embodiment, the fasteners will also engage the frame member.

It is therefore one of the principal objects of the present invention to provide a bracket for retrofitting new building panels to a structure with a minimal amount of materials and labor.

A further object of the present invention is to provide a bracket for retrofitting building panels to a structure that can be adapted for use with existing building panels having nearly any profile.

Yet another object of the present invention is to provide a bracket that reduces the typical number of steps required for retrofitting building panels to a structure.

A further object of the present invention is to provide a bracket that provides a stable mounting structure for new building panels that does not require a separate fastener means to couple the bracket to the existing building panel prior to the installation of the new building panel.

Still another object of the present invention is to provide a bracket for retrofitting new building panels to a structure that is fabricated from a generally insulative material.

Yet another object of the present invention is to provide a bracket for retrofitting new building panels to a structure that is relatively simple in construction.

These and other objects of the present invention will be clear to those of skill in the art.

DESCRIPTION OF THE PREFERRED EMBODIMENT

Figure 1:
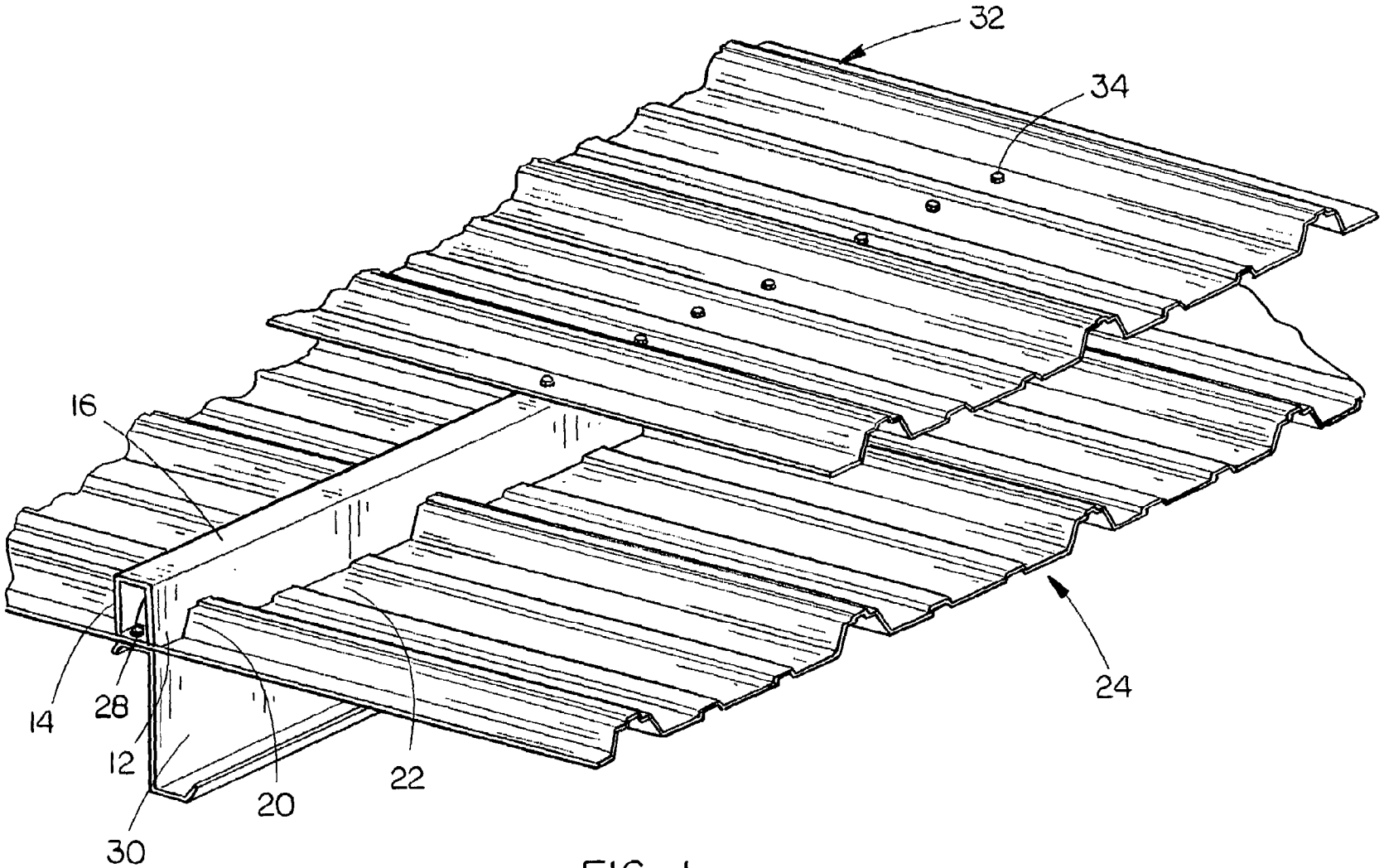
FIG. 1 is a perspective view of one embodiment of the bracket of the present invention as the same might be used to secure a new roof panel to an existing roof panel on a structure.
Figure 2:
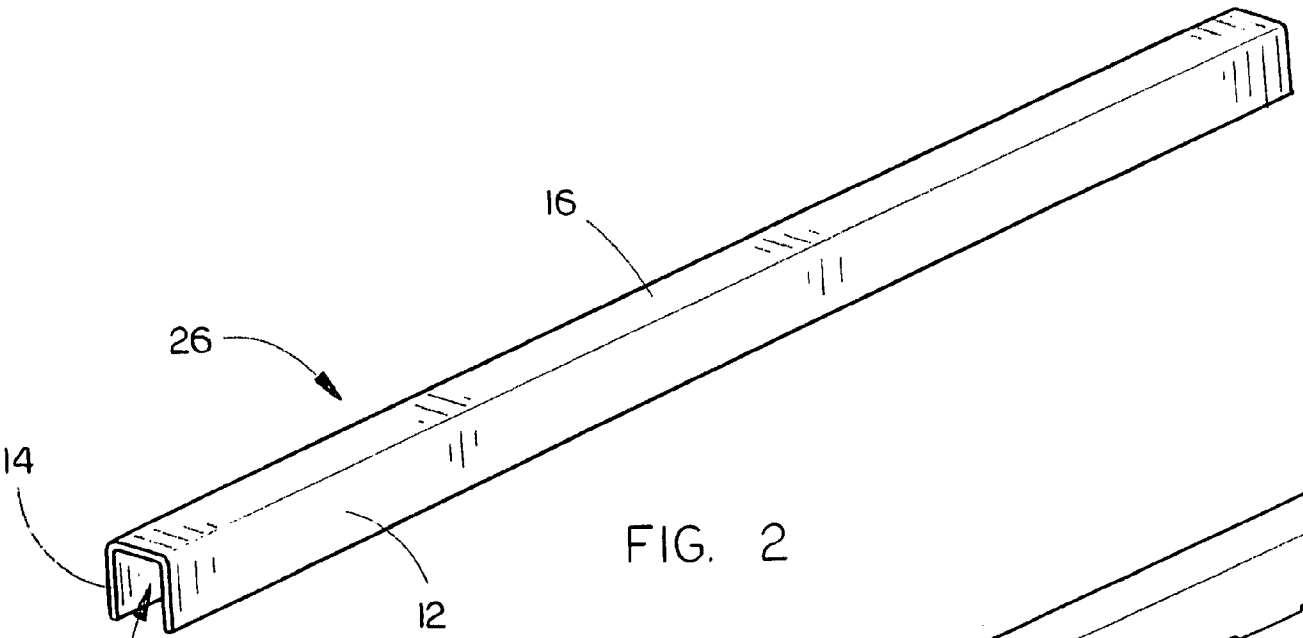
FIG. 2 is an isometric view of one embodiment of the bracket of the present invention.
Figure 3:
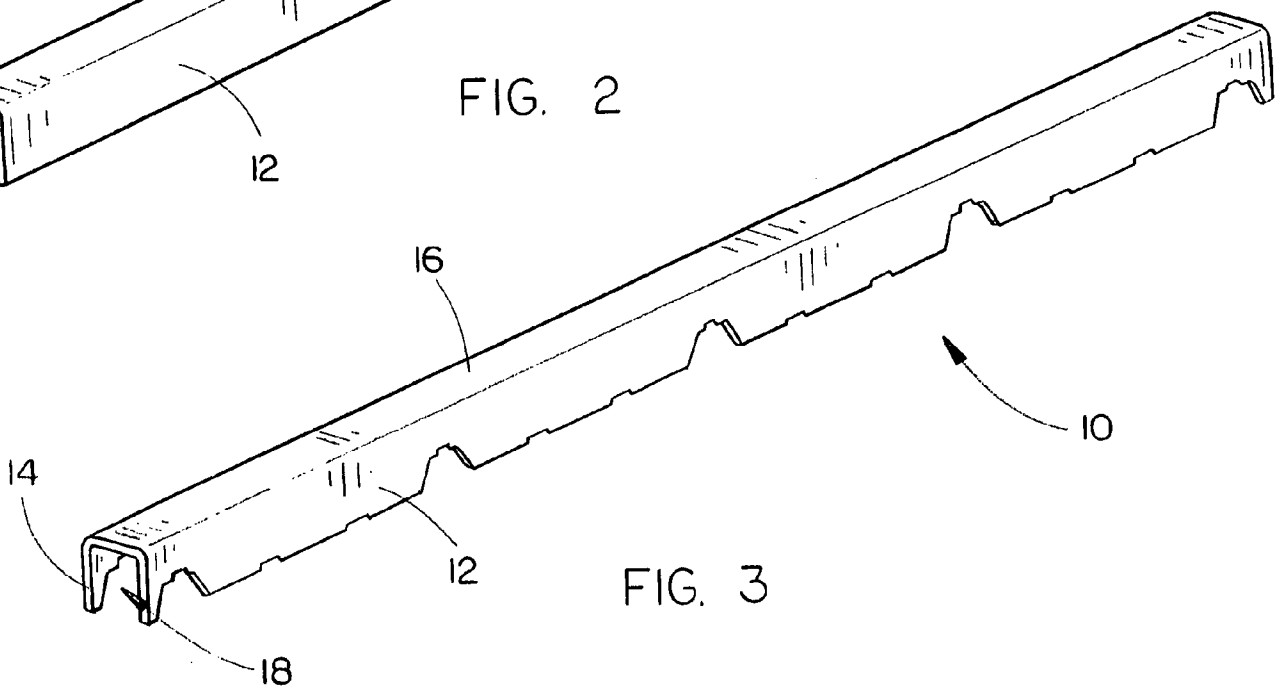
FIG. 3 is an isometric view of the bracket depicted in FIG. 1.

The bracket 10 of the present invention is generally depicted in FIGS. 1–4 in some of its possible embodiments. Generally, the bracket 10 is provided with a forward wall 12, rearward wall 14 and a top wall 16. The forward wall 12, rearward wall 14 and top wall 16 are coupled to one another so that they define a channel 18 that extends along the length of the bracket 10.

Although it is contemplated that the bracket 10 could be fabricated from nearly any material, including the various types of metals from which building panels are fabricated, it is preferred that the channel 10 be constructed from a generally insulative material such as plastic, fiberglass-reinforced plastic and the like. The insulative property will provide a benefit to the finished, retrofit building panels where differing rates of expansion and contraction between the new and existing panels is a concern. Moreover, the transmission of thermal energy will be greatly reduced. Finally, such insulative materials are easily fabricated into one of any number of shapes and sizes, depending on the particular system requirements. For example, in a preferred embodiment, the lower end portions of the forward wall 12 and the rearward wall 14 may be shaped to have a profile that mimics a profile of the rib portions 20 and valley portions 22 of the existing building panels 24, as depicted in FIG. 1.

The profile of the lower end portions of the forward wall 12 and the rearward wall 14 can be cast into molds when the bracket 10 is fabricated or shaped after the fabrication process, where either molded or non-molded materials are used. However, it is preferred that the bracket 10 be constructed such that minor alterations may be performed on the job site with a simple hand tool to marry the profile of the bracket 10 to the profile of the existing building panel 24. The bracket 10 may also be originally formed as a "blank" 26 to be shaped with a profile at a later time depending on the particular circumstances of the retrofitting job. The blank 26, shown in FIG. 2, may also be used where close conformity to the profile of the existing building panels is not necessary or desirable.

In a preferred embodiment, the channel 18 should be sized and shaped to substantially enclose one or more of the existing fasteners 28, which secure the existing building panels 24 to the frame member or purlin 30 of the structure. Typically, a plurality of existing fasteners 28 will be disposed within the existing building panel 24 in a generally straight, transverse line which indicates the location of the frame member 30 beneath the existing building panel 24. Substantially enclosing the line of fasteners 28 within the channel 18 provides a number of benefits. One such benefit is that the lower end portions of the forward wall 12 and the rearward wall 14 will tend to engage the head portion of the existing fasteners 28, thus preventing the lateral, parallel movement of the bracket 10 with respect to the existing building panel 24.

Figure 4:
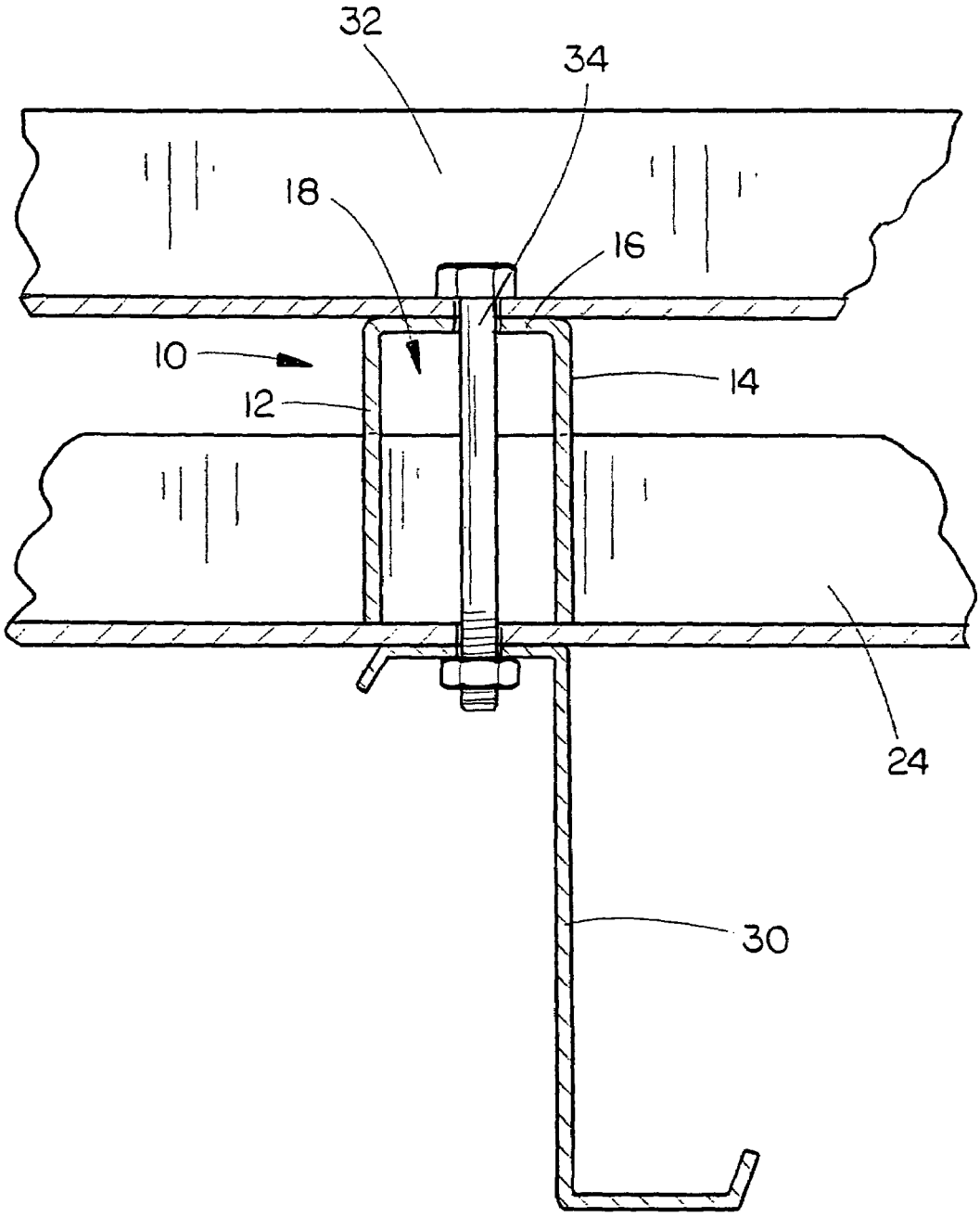
FIG. 4 is a partial side elevation view depicting one manner in which the bracket of the present invention could be used to secure a new roof panel to an existing roof panel on a structure.

In use, the bracket 10 is simply positioned so that the profile of the lower end portion of the forward wall 12 and the rearward wall 14 align with the profile of the existing building panel 24. The bracket 10 can then be placed against the existing building panel 24 so that the existing fasteners 28 are enclosed within the channel 18. A new building panel 32 may then be placed into position against the top wall 16 of the bracket 10. As can be seen in FIGS. 1 and 4, the height of the bracket 10 defines the spaced relationship between the existing building panel 24 and the new building panel 32. Therefore, where a larger or smaller distance between the two building panels is desired, the height of the bracket 10 should be fabricated or adjusted accordingly. This may become particularly relevant where an insulative material is to be disposed between the existing building panel 24 and the new building panel 32. The insulative material may be one of several known insulative materials used generally in the construction industry and should be selected based upon the particular insulating and environmental conditions present for the given job site. The distance between the existing building panel 24 and the new building panel 32 will also become a consideration where the lifting and flexing effects of wind on the building panels is a concern.

Once the new building panels 32 are in position atop the top wall 16 of the bracket 10, new fasteners 34 can be disposed through the new building panel 32 and into the bracket 10, existing building panel 24, and preferably the frame member 30 as well. However, it is contemplated that in certain applications, the new building panel 32 may be secured by engaging the fastener 34 with only the bracket 10 and the existing building panel 24. The fastener 34 depicted in FIG. 4 is shown to be a bolt and nut. However, standard roofing fasteners, self-tapping screws and the like may all be used, depending on the particular circumstances.

The forward wall 12 and rearward wall 14 are depicted in FIG. 4 as being generally parallel with one another and spaced apart by the top wall 16. However, variations to this U shape are contemplated. For example, the forward wall 12 and rearward wall 14 may be angled inwardly or outwardly somewhat. Moreover, the size and length of the top wall 16 may be varied to provide a larger or smaller surface upon which the new building panel 32 will rest. Accordingly, a V shape, C shape and other geometries are contemplated. However, it is preferred that the forward wall 12 and rearward wall 14 be of generally equal length and in a spaced-apart relationship so that a forward and rearward footing is provided for stability. Accordingly, additional resistance to the forward or rearward tipping or flexing of the new building panel 32 is provided. The stability of the new building panel 32 is amplified when used with the bracket 10 and coupled to the frame member 30, as depicted in FIG. 4. In this manner, the stability of the structure is enhanced by the shape of the bracket 10 but not solely dependent thereon.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. In combination:

a new building panel;

a structure, having at least one existing building panel with an outwardly facing surface that is shaped to have a profile defined by elongated, alternating peaks and valleys, and at least one existing fastener; and a bracket comprising:

forward and rearward spaced-apart wall members having upper and lower end portions, opposite end portions and a length extending between said opposite end portions; said lower end portions of said forward and rearward wall members being shaped and sized to marry the profile of the alternating peaks and valleys along the outwardly facing surface of the existing building panel when the bracket is positioned closely adjacent, and the length of said bracket is perpendicular to, lengths of the elongated alternating peaks and valleys of the existing building panel; and a top wall member extending between and operatively coupling the upper end portions of said forward and rearward wall members;

said forward, rearward and top wall members being coupled to one another so that they define a channel that extends at least partially along the length of the bracket; said channel being sized and shaped to enclose the at least one existing fastener.

2. The bracket of claim 1 wherein said forward and rearward wall members are spaced in a parallel relationship with one another.

3. The bracket of claim 1 wherein said forward, rearward and top wall members are comprised of an insulative material.

4. The bracket of claim 1 wherein said channel is shaped and sized to simultaneously enclose a plurality of existing fasteners that are arranged in a linear relationship with one another.

5. In combination:

a new building panel;

a structure, having at least one existing building panel with an outwardly facing surface that is shaped to have a profile defined by elongated, alternating peaks and valleys, and at least one existing fastener; and a bracket comprising:

forward and rearward spaced-apart wall members having upper and lower end portions, opposite end portions and a length extending between said opposite end portions; said lower end portions of said forward and rearward wall members being shaped and sized to marry the profile of the alternating peaks and valleys along the outwardly facing surface of the existing building panel when the bracket is positioned closely adjacent, and perpendicular to, the alternating peaks and valleys of the existing building panel; and a top wall member extending between and operatively coupling the upper end portions of said forward and rearward wall members;

said forward, rearward and top wall members being coupled to one another so that they define a channel that extends at least partially along the length of the bracket; said channel being shaped and sized to enclose and engage the at least one existing fastener in a manner that prevents said bracket from moving in a parallel fashion with respect to the at least one existing building panel.

6. The bracket of claim 1 wherein the lower end portions of said forward and rearward wall portions are shaped so that a portion of the lower end portions of said forward and rearward wall portions engage the outwardly facing surface of the at least one existing building panel.

7. The bracket of claim 1 wherein said forward, rearward and top wall members are positioned with respect to one another to provide the bracket with a generally U-shaped cross-section.

8. A method of retrofitting at least one new building panel and at least one new fastener to a structure having at least one existing building panel, with an outwardly facing surface that is shaped to have a profile defined by elongated, alternating peaks and valleys, which is secured to a frame member with at least one existing fastener, comprising the steps of:

providing at least one bracket comprising forward and rearward spaced-apart wall members, having upper and lower end portions, coupled to one another by a top wall member; and providing said at least one bracket with a channel, defined by said forward, rearward and top wall members, which extends at least partially along a length of said at least one bracket and is sized and shaped to enclose said at least one existing fastener;

providing said lower end portions of said forward and rearward wall members with a shape that will marry the profile of the alternating peaks and valleys along the outwardly facing surface of the existing building panel when said brace is positioned closely adjacent, and perpendicular to, the alternating peaks and valleys of the at least one existing building panel;

aligning said at least one bracket so that the length of said at least one bracket is positioned perpendicular to lengths of said elongated, alternating peaks and valleys, the profile of said bracket is married to the profile of the at least one existing building panel, and the at least one existing fastener is enclosed within said channel;

positioning the at least one new building panel on the top wall member of said at least one bracket;

securing the at least one new building panel to said bracket and the frame member with the at least one new fastener.

9. The method of claim 8 further comprising the step of forming said bracket from an insulative material.

10. The method of claim 8 wherein said forward and rearward wall members are positioned in a parallel relationship with one another.

11. The method of claim 8 further comprising the step of disposing a layer of insulative material between the at least one existing building panel and the at least one new building panel.

12. A method of retrofitting at least one new building panel and at least one new fastener to a structure having at least one existing building panel, with an outwardly facing surface that is shaped to have a profile defined by elongated, alternating peaks and valleys, which is secured to a frame member with a plurality of existing fasteners, which are linearly arranged with respect to one another, the method comprising the steps of:

providing at least one bracket comprising forward and rearward spaced-apart wall members, having upper and lower end portions, coupled to one another by a top wall member; and providing said at least one bracket with a channel, defined by said forward, rearward and top wall members, which extends at least partially along a length of said at least one bracket and is sized and shaped to enclose said plurality of existing fasteners;

providing said lower end portions of said forward and rearward wall members with a shape that will marry the profile of the alternating peaks and valleys along the outwardly facing surface of the existing building panel when said brace is positioned closely adjacent, and generally perpendicular to, the alternating peaks and valleys of the at least one existing building panel;

aligning said at least one bracket so that the profile of said bracket is married to the profile of the at least one existing building panel and the plurality of existing fasteners are enclosed within said channel and engage said bracket in a manner that prevents movement of said bracket along the lengths of the elongated, alternating peaks and valleys of the at least one existing building panel;

positioning the at least one new building panel on the top wall member of said at least one bracket;

securing the at least one new building panel to said bracket and the frame member with the at least one new fastener.

13. A method of retrofitting at least one new building panel and at least one new fastener to a structure having at least one existing building panel, with an outwardly facing surface that is shaped to have a profile defined by elongated, alternating peaks and valleys, which is secured to a frame member with at least one existing fastener, comprising the steps of:

providing at least one bracket comprising forward and rearward spaced-apart wall members, having upper and lower end portions, coupled to one another by a top wall member; and providing said at least one bracket with a channel, defined by said forward, rearward and top wall members, which extends at least partially along a length of said at least one bracket and is sized and shaped to enclose said at least one existing fastener;

providing said lower end portions of said forward and rearward wall members with a shape that will marry the profile of the alternating peaks and valleys along the outwardly facing surface of the existing building panel when said brace is positioned closely adjacent, and perpendicular to, the alternating peaks and valleys of the at least one existing building panel;

aligning said at least one bracket so that the profile of said bracket is married to the profile of the at least one existing building panel and the at least one existing fastener is enclosed within said channel;

positioning the at least one new building panel on the top wall member of said at least one bracket;

securing the at least one new building panel to said bracket and the frame member with the at least one new fastener; said bracket being coupled to the at least one existing building panel using only the at least one new fastener used to secure the at least one new building panel to said bracket and said frame member.

14. The method of claim 8 wherein said channel is sized and shaped to enclose the at least one existing fastener such that said bracket is prevented from parallel movement with respect to the at least one existing building panel.

15. The method of claim 8 wherein said bracket is provided with a generally U-shaped cross-section.

* * * * *